US008179194B2

(12) United States Patent
Li et al.

(10) Patent No.: US 8,179,194 B2
(45) Date of Patent: May 15, 2012

(54) SYSTEM AND METHOD FOR A REFERENCE GENERATOR

(75) Inventors: Minsheng Li, Santa Clara, CA (US); Gong Tom Lei, Austin, TX (US); Song Liu, Cupertino, CA (US); Jun Xiong, Santa Clara, CA (US); Yincai Liu, Santa Clara, CA (US); Feiqin Yang, Fremont, CA (US); Zu Xu Qin, Sunnyvale, CA (US)

(73) Assignee: FutureWei Technologies, Inc., Plano, TX (US)

( * ) Notice: Subject to any disclaimer, the term of this patent is extended or adjusted under 35 U.S.C. 154(b) by 159 days.

(21) Appl. No.: 12/771,944

(22) Filed: Apr. 30, 2010

(65) Prior Publication Data

US 2010/0283535 A1 Nov. 11, 2010

Related U.S. Application Data

(60) Provisional application No. 61/175,584, filed on May 5, 2009.

(51) Int. Cl.
*G05F 1/10* (2006.01)

(52) U.S. Cl. ..... 327/541

(58) Field of Classification Search ..... 327/541
See application file for complete search history.

(56) References Cited

U.S. PATENT DOCUMENTS

| | | | | |
|---|---|---|---|---|
| 6,580,326 | B2 * | 6/2003 | Bach et al. | 330/277 |
| 7,019,580 | B1 * | 3/2006 | Michalski | 327/427 |
| 7,026,824 | B2 * | 4/2006 | Chen | 324/541 |
| 7,081,774 | B2 * | 7/2006 | Miyake et al. | 326/83 |
| 7,215,182 | B2 * | 5/2007 | Ali | 327/538 |
| 7,265,607 | B1 * | 9/2007 | Rajapandian et al. | 327/541 |
| 7,525,370 | B2 * | 4/2009 | Gicquel et al. | 327/538 |
| 7,636,057 | B2 * | 12/2009 | Patterson et al. | 341/158 |
| 7,719,345 | B2 * | 5/2010 | Cho et al. | 327/538 |
| 7,907,074 | B2 * | 3/2011 | Zanchi et al. | 341/155 |
| 7,956,597 | B2 * | 6/2011 | Liao et al. | 323/313 |
| 2002/0093316 | A1 * | 7/2002 | Fahrenbruch | 323/273 |
| 2010/0327944 | A1 * | 12/2010 | Lei et al. | 327/427 |

OTHER PUBLICATIONS

Yu, H., et al., "A 12b 50MSPS 34mW Pipelined ADC," IEEE 2008 Custom Integrated Circuits Conference, 2008, pp. 297-300.

Singer, L., et al., "A 12b 65MSample/s CMOS ADC with 82dB SFDR at 120MHz," IEEE International Solid-State Circuits Conference, Feb. 2000, pp. 38-39.

* cited by examiner

*Primary Examiner* — Thomas J Hiltunen
(74) *Attorney, Agent, or Firm* — Slater & Matsil, L.L.P.

(57) ABSTRACT

In one embodiment, a circuit for generating a reference voltage between a first output and a second output, has a first follower transistor that includes a first control node, a first follower node coupled to a first output, and a first supply node, and a second follower transistor that includes a second control node, a second follower node coupled to a second output and a second supply node. A first voltage drop circuit is coupled between a circuit supply node and the second supply node. The circuit is biased such that the voltage between the circuit supply node and the second supply node is greater than the voltage between the circuit supply node and the first supply node, and such that the voltage between the circuit supply node and the second control node is greater than the voltage between the circuit supply node and the first control node.

26 Claims, 6 Drawing Sheets

SYSTEM AND METHOD FOR A REFERENCE GENERATOR

TECHNICAL FIELD

The present invention relates generally to semiconductor circuits, and more particularly to a system and method for a reference generator.

BACKGROUND

Reference generators are important components in analog-to-digital converters (ADC), especially for high-speed, high-resolution ADCs. They generate and maintain a desired constant reference voltage used by the ADC to perform accurate analog to digital conversions. In ADCs that use switched capacitor circuit techniques, a reference voltage is typically coupled to conversion circuits through switched capacitor loads.

Because the generated reference voltage is directly involved in the analog-to-digital calculation, errors in the reference will lead to performance degradation of the ADC. Such performance degradation can include a reduction in the Signal-to-Noise Ratio (SNR) or a reduction in the Equivalent Number of Bits (ENOB). Further sources of error and performance degradation include insufficient settling error after switching glitches and supply noise disturbance, etc. Poor power supply noise rejection exacerbates the effects of supply noise disturbance.

One way to improve the power supply rejection ratio (PSRR) of a reference generator is to use large decoupling capacitors and/or adopt a reference generator using large off-chip capacitors. Such techniques, however, can come at the expense of increased die size, additional pin count, increased circuit complexity, and additional off-chip components.

SUMMARY OF THE INVENTION

In one embodiment, a circuit for generating a reference voltage between a first output and a second output, includes a first follower transistor that has a first control node, a first follower node coupled to a first output, and a first supply node, and a second follower transistor that has a second control node, a second follower node coupled to a second output and a second supply node. A first voltage drop circuit is coupled between a circuit supply node and the second supply node. The circuit is biased such that the voltage between the circuit supply node and the second supply node is greater than the voltage between the circuit supply node and the first supply node, and such that the voltage between the circuit supply node and the second control node is greater than the voltage between the circuit supply node and the first control node.

In another embodiment, a system and method for generating a reference voltage is disclosed. The system has an amplifier with first and second forward path outputs, and with first and second feedback path inputs. Control nodes of a first and third follower transistor are coupled to the first forward path output, and the control nodes of the second and fourth follower transistors are coupled to the second forward path output. Follower nodes of the first and second follower transistors are coupled to the first and second feedback inputs, respectively, and follower nodes of the third and fourth transistors are coupled to a first and second system output respectively. An offset circuit is configured to provide a voltage offset between supply nodes of the first and second follower transistors, and provide a corresponding voltage offset between supply nodes of the third and fourth follower transistors.

The foregoing has outlined, rather broadly, features of the present invention. Additional features of the invention will be described, hereinafter, which form the subject of the claims of the invention. It should be appreciated by those skilled in the art that the conception and specific embodiment disclosed may be readily utilized as a basis for modifying or designing other structures or processes for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a more complete understanding of the embodiments, and the advantages thereof, reference is now made to the following descriptions taken in conjunction with the accompanying drawings, in which.

DETAILED DESCRIPTION OF ILLUSTRATIVE EMBODIMENTS

The making and using of the embodiments are discussed in detail below. It should be appreciated, however, that the present invention provides many applicable inventive concepts that can be embodied in a wide variety of specific contexts. The specific embodiments discussed are merely illustrative of specific ways to make and use the invention, and do not limit the scope of the invention.

The present invention will be described with respect to embodiments in a specific context, namely a system and method for a reference generator. Embodiments of this invention may also be applied to systems and methods directed toward circuit and methods that produce voltage references.

In embodiments of the present invention, a differential reference voltage is produced with open-loop source follower transistors that are biased by a replica-bias circuit having a differential amplifier and pair of replica source follower transistors in a feedback loop. A voltage drop circuit is coupled in series with at least one of the open-loop source follower transistors. In some embodiments, the reference generator is implemented on-chip as has fast settling behavior and a high power supply rejection ratio (PSRR).

Figure 1:
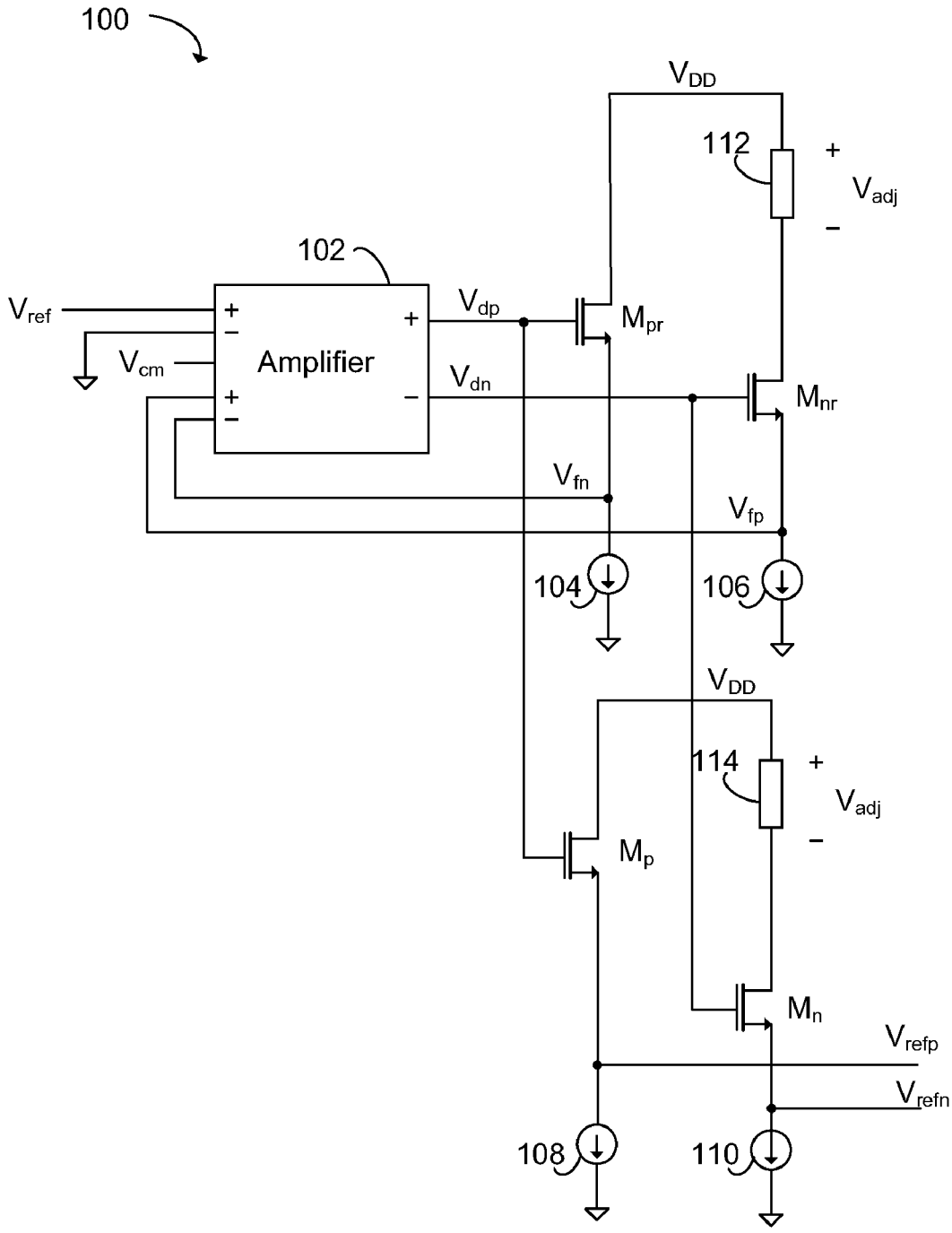
FIG. 1 illustrates a differential voltage reference generator according to an embodiment.

FIG. 1 illustrates embodiment differential reference circuit 100. The output of reference circuit 100 is taken differentially at $V_{refp}$ and $V_{refn}$. Reference generator 100 has differential amplifier 102, open-loop source follower output transistors $M_p$ and $M_n$, replica bias transistors $M_{pr}$ and $M_{nr}$, and voltage drop circuits 112 and 114. Transistors $M_{pr}$, $M_{nr}$, $M_p$, and $M_n$ are biased by current sources 104, 106, 108 and 110, respectively.

The gates of open-loop source follower output transistors $M_p$ and $M_n$ and replica bias transistors $M_{pr}$ and $M_{nr}$ are driven by outputs $V_{dp}$ and $V_{dn}$ of differential amplifier 102, and the sources of replica bias transistors $M_{pr}$ and $M_{nr}$ are fed back to differential amplifier at nodes $V_{fn}$ and $V_{fp}$, respectively. Amplifier 102 and devices $M_{pr}$ and $M_{nr}$ form a feedback loop that imposes input voltage $V_{ref}$ across nodes $V_{fp}$ and $V_{fn}$. The feedback action of the loop imposes reference voltage $V_{ref}$ on nodes $V_{fp}$ and $V_{fn}$, as well as on output modes $V_{refp}$ and $V_{refn}$. In alternative embodiments of the present invention, the gain, DC bias and feedback factor of the loop can be adjusted to provide a scaled and offset version of voltage $V_{ref}$ at nodes $V_{fp}$ and $V_{fn}$. Because open-loop source follower output transistors $M_p$ and $M_n$ are outside of the feedback loop, devices $M_p$ and $M_n$ can respond quickly to transients.

In an embodiment, transistors $M_p$ and $M_n$ are matched to devices $M_{pr}$ and $M_{nr}$ in terms of device size and bias current. In some embodiments, the bias current and width/length ratio of transistors $M_p$ and $M_n$ is be a multiple of N times the bias current width/ratio of $M_{pr}$ and $M_{nr}$.

Voltage drop circuits 112 and 114 are coupled between the drain of $M_{nr}$ and $V_{dd}$, and between the drain of $M_n$ and $V_{dd}$, respectively. By providing offset voltage $V_{adj}$ across voltage drop circuits 112 and 114, PSRR is increased. In one embodiment, $V_{adj}$ is chosen such that the drain-source voltage of $M_{pr}$ is about the same as the drain-source voltage of $M_{nr}$, and the drain-source voltage of $M_n$ is about the same as the drain-source voltage of $M_p$. Alternatively, $V_{adj}$ can be chosen to maximize the PSRR of reference circuit 100. In further embodiments, other values for $V_{adj}$ can be chosen.

Figure 2:
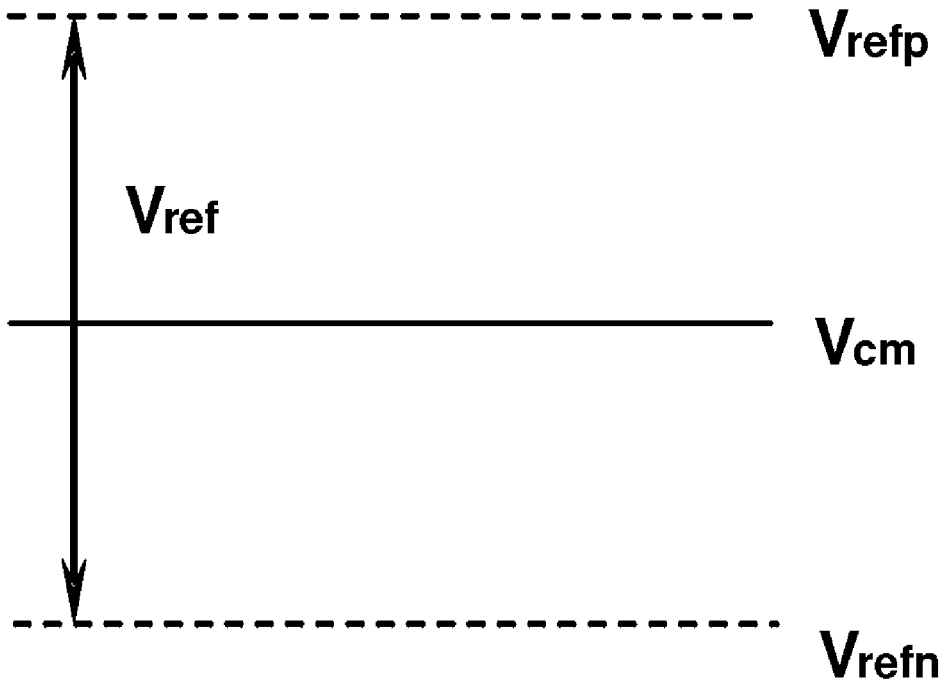
FIG. 2 illustrates graph of an embodiment differential voltage scheme.

In an embodiment, signal $V_{cm}$ provides a common-mode reference voltage, as shown in FIG. 2, which illustrates an embodiment differential voltage reference scheme. Reference voltage $V_{ref}$ is generated as a voltage between $V_{refp}$ and $V_{refn}$. In some embodiments, common mode voltage $V_{cm}$ is set to be at $V_{DD}/2$, or one half of the power supply voltage. In further embodiments, $V_{cm}$ can be set to other voltages using, for example, a different multiple of $V_{DD}$, or by using a fixed voltage reference, such as a bandgap reference circuit.

Figure 3:
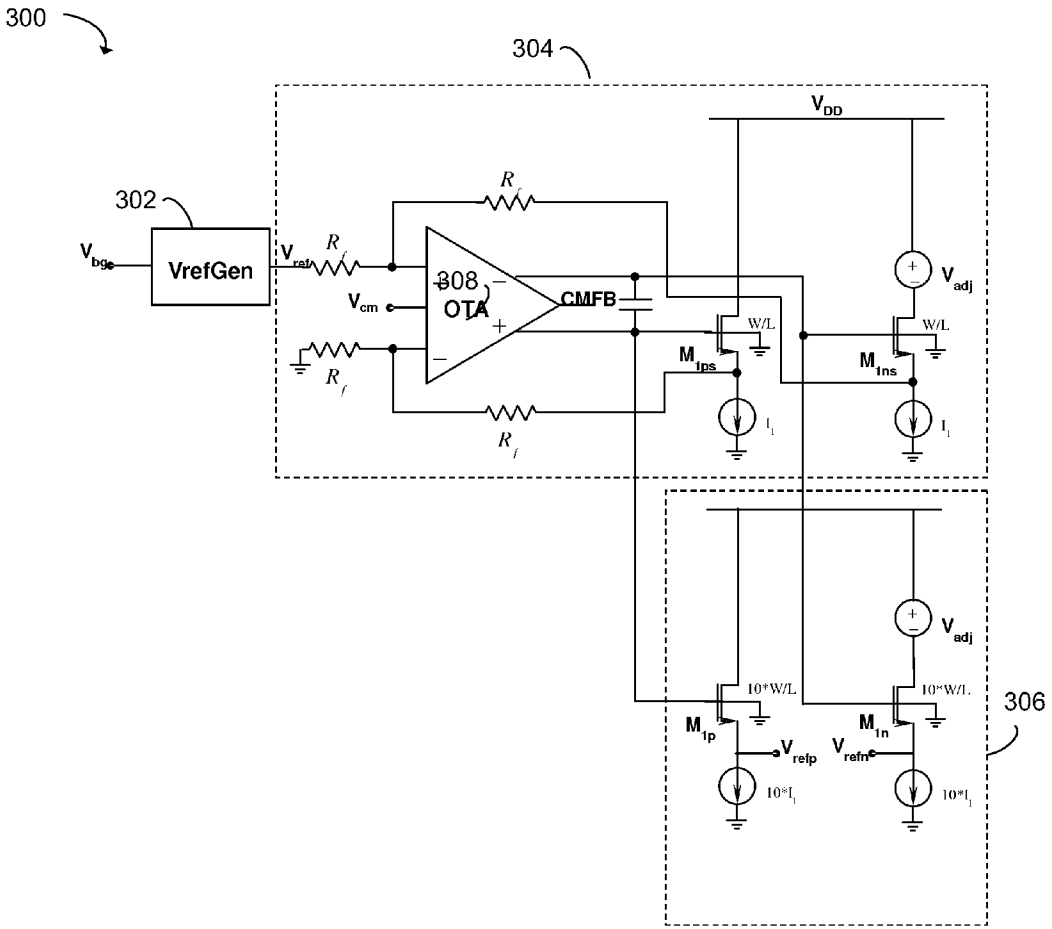
FIG. 3 illustrates a differential voltage reference generator according to another embodiment.

FIG. 3 illustrates reference generator 300 according to a further embodiment of the present invention. VrefGen block 302 takes bandgap voltage $V_{bg}$ as an input and generates single-ended reference voltage $V_{ref}$ that represents a full-range output differential voltage. In embodiments, VrefGen block 302 is implemented according to techniques known in the art, for example, a reisistor ladder. $V_{ref}$ is then converted to a differential reference voltage with a common mode level at $V_{cm}$. In some embodiments, $V_{cm}=V_{DD}/2$, however, other common mode reference voltages can be used depending on the particular application and its requirements.

In an embodiment, unity-gain resistive feedback inverting amplifier 304 is used to produce the reference voltage. Operational-transconductance amplifier (OTA) 308 provides DC gain while the source follower pair made of transistors $M_{1ps}$ and $M_{1ns}$ buffer the high output impedance of OTA 308 to enable unity-gain resistive feedback. In embodiments, OTA 308 is implemented as a fully differential amplifier with a common-mode feedback and/or common mode output voltage control. Alternatively, non-unity-gain resistive feedback can be used. In further embodiments, other amplifier topologies can be used in place of the OTA, for example an operational amplifier.

Differential reference outputs, $V_{refp}$ and $V_{refn}$, are generated by the output source follower pair made of transistors $M_{1p}$ and $M_{1n}$ in output stage 306. The gate bias of transistors $M_{1p}$ and $M_{1n}$ are mirrored from the pair $M_{1ps}$ and $M_{1ns}$ in the loop. In the illustrated embodiment, output stage source follower transistors $M_{1ps}$ and $M_{1n}$ have a multiplication ratio of ten with respect to reference source followers $M_{1ps}$ and $M_{1ns}$. In alternative embodiments, other multiplication ratios can be used. In one embodiment, by keeping output stage source follower transistors $M_{1p}$ and $M_{1n}$ outside of the feedback loop, the bandwidth of the reference output is not limited by the bandwidth of the OTA-$R_f$-source follower feedback loop. A low output impedance over a wide bandwidth can, therefore, be realized by sizing and biasing the output stage transistors $M_{1p}$ and $M_{1n}$. Meanwhile, desired differential reference levels can be maintained because the output source follower pair made of transistors $M_{1p}$ and $M_{1n}$ is mirrored from the source follower pair made of $M_{1ps}$ and $M_{1ns}$ inside the loop.

As shown in FIG. 3, DC offset $V_{adj}$ is introduced in the negative output source follower path ($M_{1n}$) so that the drain-source voltage $V_{ds}$ of the input NMOS devices $M_{1p}$ and $M_{1n}$ are about the same. For example, in an embodiment, $V_{adj} \approx V_{ref}$. In alternative embodiments, $V_{adj}$ can be greater than or less than $V_{ref}$. In an embodiment, this $V_{ds}$ symmetry improves the PSRR performance of reference generator 300. The same DC offset $V_{ref}$ is also applied to the source follower $M_{1ns}$ path in order to improve the accuracy of the mirroring between the source follower pair ($M_{1p}$,$M_{1n}$) and the pair ($M_{1ps}$, $M_{1ns}$). Alternatively, a different DC offset can be applied to source follower $M_{1ns}$.

Figure 4:
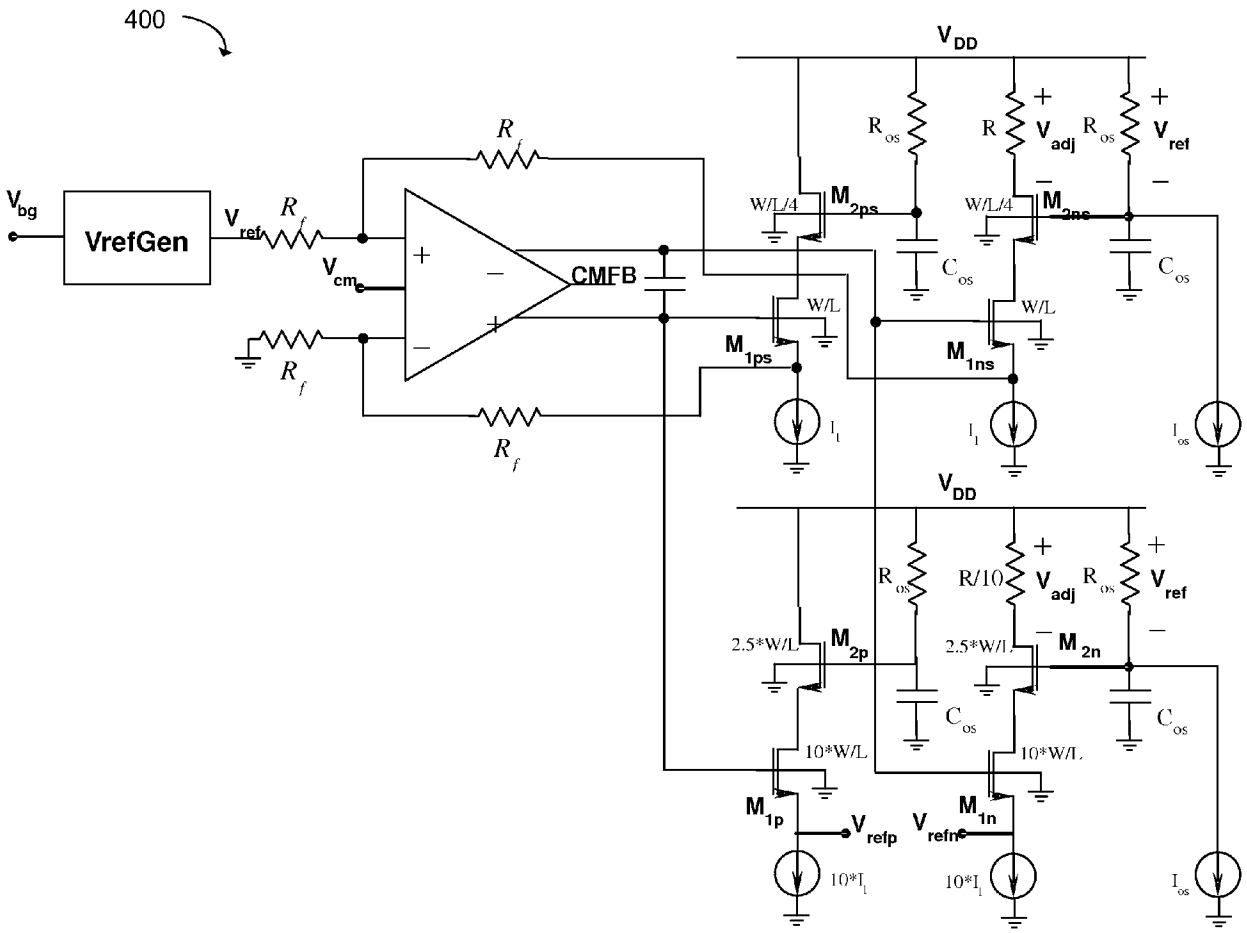
FIG. 4 illustrates a differential voltage reference generator according to a further embodiment.

FIG. 4 illustrates reference generator 400 according to a further embodiment of the present invention. The DC $V_{adj}$ is implemented by series connected resistor on the negative output source follower paths, for example resistor R in series with $M_{1ns}$ and resistor R/10 in series with $M_{1n}$. In one embodiment, the resistance is chosen such that $V_{ref}=I_1*R$. A cascode stage made of transistors $M_{2n}$ and $M_{2ns}$ is inserted between the resistors and the input NMOS devices $M_{1n}/M_{1ns}$ to reduce the impedance seen at the drain nodes of $M_{1n}$ and $M_{1ns}$.

In an embodiment that provides for low-voltage operation, all NMOS devices used in the two source follower pairs, for example, $M_{1p}$, $M_{1n}$, $M_{1ps}$, $M_{1ns}$, $M_{2p}$, $M_{2n}$, $M_{2ps}$, $M_{2ns}$ are native NMOS types, which have very low threshold voltages, for example about zero volts. In some embodiments that use native NMOS devices, boosted voltage supplies are not necessary. In alternative embodiments of the present invention, a boosted supply may be necessary depending on the particular embodiment and its specifications. Furthermore, other devices besides NMOS devices can be used, for example, PMOS or BJT devices.

Figure 5:
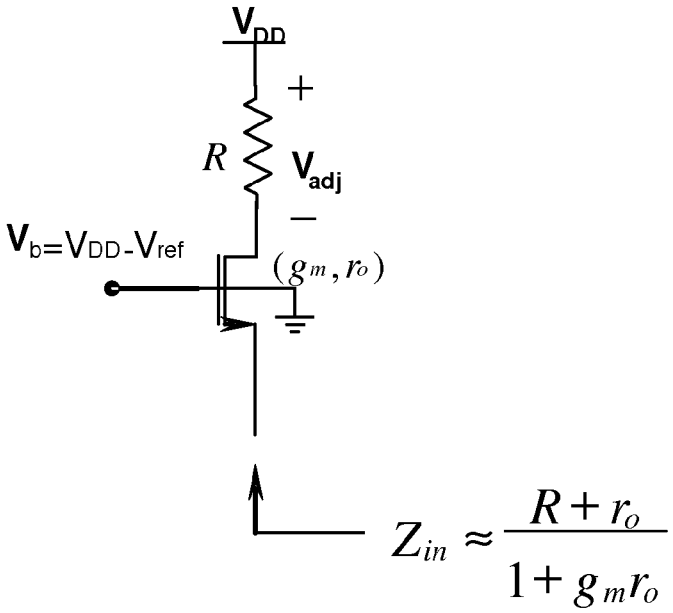
FIG. 5 illustrates a portion of an embodiment voltage offset circuit.

As shown in FIG. 5, the effective impedance seen at the drain nodes of $M_{1n}$ and $M_{1ns}$ is roughly equal to $$\frac{R}{1+g_m r_o}+\frac{1}{g_m}.$$

The resistance R is reduced by roughly the intrinsic gain of the cascode stage $g_m r_o$. In an embodiment, this lowering of resistance reduces peaking of the reference generator output impedance over frequency that may compromise fast settling behavior. To maintain symmetry between the positive and negative paths, diode-connected NMOS devices $M_{2p}$ and $M_{2ps}$ are placed in the positive output path. (See FIG. 4.) In an embodiment, NMOS devices are $M_{2p}$ and $M_{2ps}$ sized about the same as devices $M_{2n}$ and $M_{2ns}$. Alternatively other size ratios can be used or $M_{2p}$ and $M_{2ps}$ can be omitted.

Figure 6:
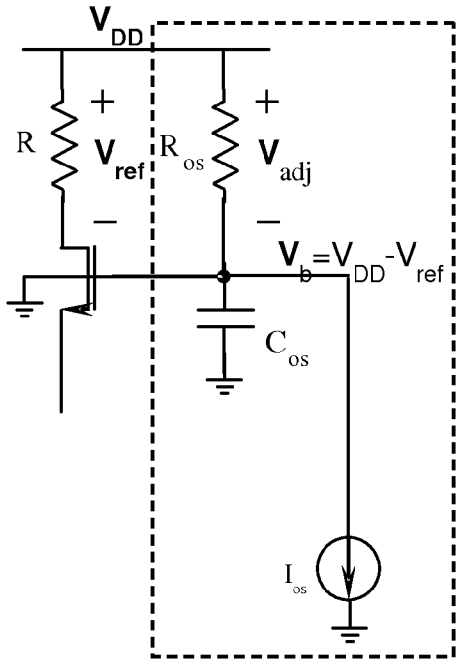
FIG. 6 illustrates an embodiment gate bias circuit.

One embodiment implementation of gate bias $V_b$ for the cascode devices $M_{2n}$ and $M_{2ns}$ is shown in FIG. 6. By choosing $R_{os}$ and $I_{os}$ appropriately, the bias voltage at the gates of $M_{2n}$ and $M_{2ns}$ can be set to be about $V_b=V_{DD}-V_{ref}=V_{DD}-I_{os}*R_{os}$. Shunt capacitor $C_{os}$ at the gates of the $M_{2n}$ and $M_{2ns}$ helps maintain a common gate configuration at high frequencies by providing an AC ground. $R_{os}$ and $C_{os}$ form a low pass filter that attenuates supply noise at the gates of $M_{2n}$ and $M_{2ns}$. To maintain symmetry between the positive and negative output paths, a similar $R_{os}$ and $C_{os}$ are coupled to the gates of $M_{2p}$ and $M_{2ps}$, as shown in FIG. 4.

In one example embodiment, $V_{DD}$=1.8V, $V_{ref}$=600 mV, $I_{os}$=20 μA, and $R_{os}$=30K Ohms, R=400 Ohms, $I_1$=1.5 mA, and output stage current $10*I_1$=15 mA. Capacitor $C_{os}$ is set to 10 pF in order to provide an AC path to ground at the gates of $M_{2n}$ and $M_{2ns}$. Here, reference generator can provide a reference voltage for an ADC that settles fast enough to provide a voltage reference for a 200 Ms/s ADC. In alternative embodiments of the present invention, other component values can be used.

Figure 7:
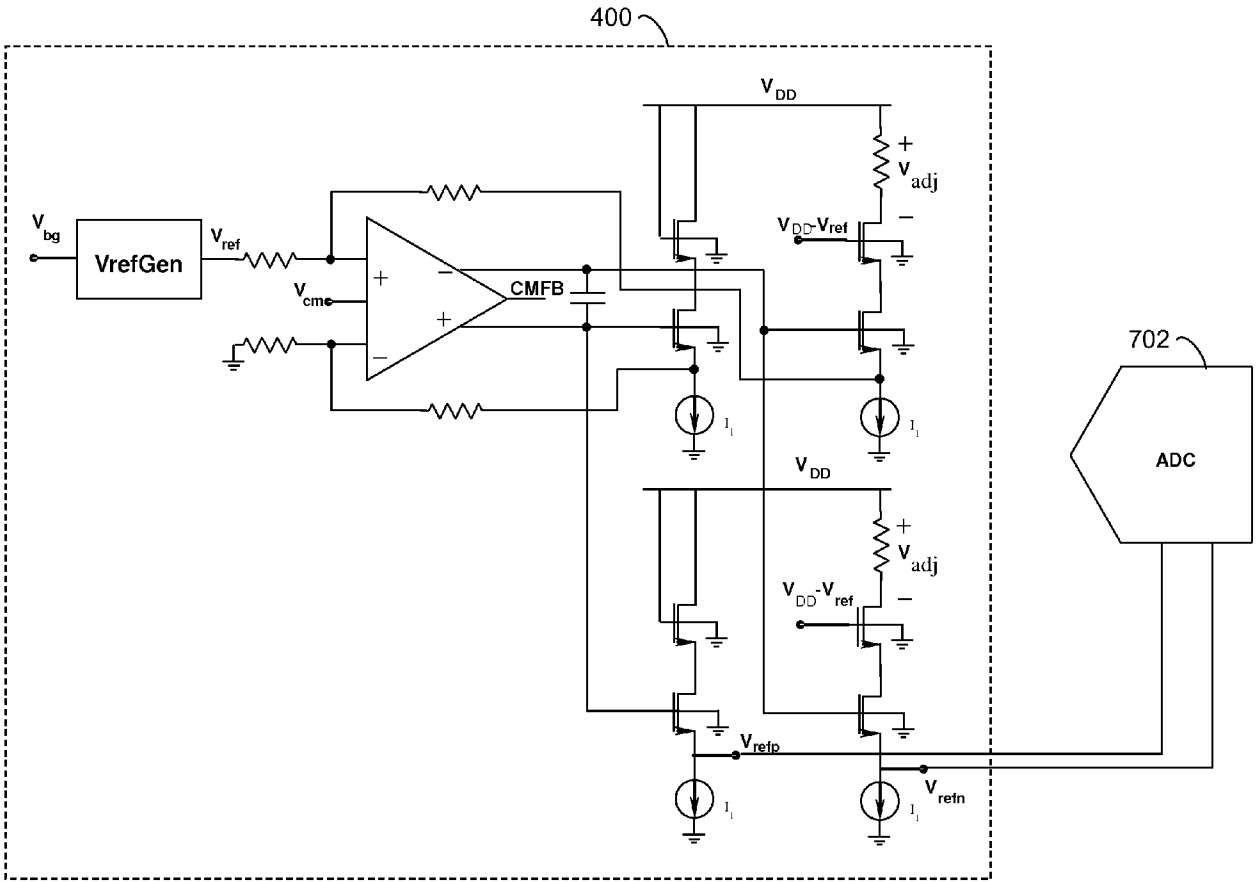
FIG. 7 illustrates an embodiment system implementation of an embodiment reference generator.

FIG. 7 illustrates an embodiment ADC system that uses embodiment differential reference generator 400 to provide a reference for ADC 702. In some embodiments, ADC core 702 is a high-speed, high-resolution ADC. In alternative embodiments, embodiment differential voltage reference circuits can be use to provide references for such circuits as high-speed high resolution pipelined ADCs.

In an embodiment, a circuit for generating a reference voltage between a first output and a second output, has a first follower transistor that includes a first control node, a first follower node coupled to a first output, and a first supply node, and a second follower transistor that includes a second control node, a second follower node coupled to a second output and a second supply node. A first voltage drop circuit is coupled between a circuit supply node and the second supply node. The circuit is biased such that the voltage between the circuit supply node and the second supply node is greater than the voltage between the circuit supply node and the first supply node, and such that the voltage between the circuit supply node and the second control node is greater than the voltage between the circuit supply node and the first control node.

In an embodiment, the first voltage drop circuit includes a cascode transistor. According to another embodiment, the first and second follower transistors are operated in an open-loop configuration and/or the first control node and the second control node are biased by a replica bias circuit. In some embodiments, the first voltage drop circuit is biased such that a potential difference between the first supply node and the first follower nodes is substantially the same as a potential difference between the second supply node and the second follower node. In a further embodiment, the first voltage drop circuit is biased to substantially minimize signal transfer from circuit supply to the voltage reference.

In a further embodiment, the circuit also includes a driver coupled to the first control node and the second control node. In some embodiments, the driver includes an amplifier having a first amplifier output coupled to the first control node and a second amplifier output coupled to the second control node. In some embodiments the circuit also includes a third and a fourth follower transistor. The third follower transistor has a third control node coupled to the first amplifier output, a third follower node coupled to a first input of the amplifier, and a third supply node, and the fourth follower transistor has a fourth control node coupled to the second amplifier output, a fourth follower node coupled to a second input of the amplifier and a fourth supply node.

In an embodiment, the circuit also has a second voltage drop circuit coupled between a reference node and the fourth supply node. In a further embodiment, the reference node comprises the circuit supply node.

In an embodiment, the first, second, third and fourth follower transistors are made of MOS transistors, where the first, second, third and fourth control nodes are gates, the first, second, third and fourth follower nodes are sources and the first, second, third and fourth supply nodes are drains. In some embodiments, the circuit is implemented on an integrated circuit.

In one embodiment, a system and method for generating a reference voltage includes an amplifier with first and second forward path outputs, and with first and second feedback path inputs. Control nodes of a first and third follower transistor are coupled to the first forward path output, and the control nodes of the second and fourth follower transistors are coupled to the second forward path output. Follower nodes of the first and second follower transistors are coupled to the first and second feedback inputs, respectively, and follower nodes of the third and fourth transistors are coupled to a first and second system output respectively. An offset circuit is configured to provide a voltage offset between supply nodes of the first and second follower transistors, and provide a corresponding voltage offset between supply nodes of the third and fourth follower transistors.

In a further embodiment, the offset circuit includes a first cascode transistor coupled to the supply node of the first follower transistor, a second cascode transistor coupled to the supply node of the second follower transistor, a third cascode transistor coupled to the supply node of the third follower transistor, and a fourth cascode transistor coupled to the supply node of the fourth follower transistor. In one embodiment, the offset circuit further includes a first resistor coupled to the supply node of the first cascode transistor, a second resistor coupled to the supply node of the third cascode transistor, a first RC low-pass filter, and current source coupled to the control node of the first cascode transistor. The offset circuit also includes a second RC low-pass filter coupled to the control node of the second cascode transistor, a third RC low-pass filter, and current source coupled to the control node of the third cascode transistor; and a fourth RC low-pass filter coupled to the control node of the fourth cascode transistor.

In an embodiment, the amplifier further includes a differential operational transconductance amplifier (OTA) coupled to the first and second forward path outputs, and a resistive feedback network coupled to the first and second feedback path inputs.

In some embodiments, the first, second, third and fourth follower transistors are MOS transistors, and the first, second, third and fourth cascode transistors are MOS transistors. The control nodes of the first, second, third and fourth transistor are gates, the follower output nodes of the first, second, third and fourth transistor are sources; and the supply nodes of the first, second, third and fourth transistor are drains. In a further embodiment the first, second, third and fourth follower transistors, and the first, second, third and fourth cascode transistors comprise are native MOS transistors.

In an embodiment, method of generating a differential reference voltage includes driving the differential reference voltage from a first follower node of a first transistor and a second follower node of a second transistor. The differential reference voltage is generated such that a voltage difference from a reference supply to the first follower node from the first transistor is less than a voltage difference from the reference supply to the second follower node of the second transistor. The method further includes providing a voltage drop from the reference supply to a supply node of the second transistor and adjusting the voltage drop to minimize signal transfer from the reference supply to the differential reference voltage.

In an embodiment, the first and second, transistors are MOS transistors, the first and second follower nodes are sources, and the supply node of the second transistor comprises a drain.

In an embodiment, the method also includes generating a first differential voltage between a control node of the first transistor and a control node of the second transistor. Generating the first differential voltage also includes driving a control node of a first replica transistor and a control node and a second replica transistor with the first differential voltage using an amplifier, providing feedback from follower nodes of the first and second replica transistors to at least one input of the amplifier, and driving the first and second transistors in an open-loop configuration.

An advantage of an embodiment of the present invention includes reduction in reference generator error by having a high PSRR and/or a wideband low output impedance at the output reference nodes. By having a high PSRR, errors caused by power supply noise are reduced, and by having a low wideband output impedance, voltage spikes occurring after circuit switching activity is reduced, thereby allowing for better setting activity.

An advantage of an embodiment reference generator that outputs a differential voltage referenced to a fixed voltage reference circuit, such as a bandgap generator, is that full range of the differential reference $V_{ref}$ can be made insensitive to process, voltage, and temperature variations. It can be generated from a bandgap voltage.

Although the embodiments and their advantages have been described in detail, it should be understood that various changes, substitutions and alterations can be made herein without departing from the spirit and scope of the invention. Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed, that perform substantially the same function or achieve substantially the same result as the corresponding embodiments described herein may be utilized according to the present invention.

What is claimed is:

1. A circuit for generating a reference voltage between a first output and a second output, the circuit comprising:

a first follower transistor comprising a first control node, a first follower node coupled to a first output, and a first supply node;

a second follower transistor comprising a second control node;

a second follower node coupled to a second output;

a second supply node;

a first voltage drop circuit coupled between a circuit supply node and the second supply node, wherein, the circuit is biased such that a potential difference between the circuit supply node and the second supply node is greater than a potential difference between the circuit supply node and the first supply node, and the circuit is further biased such that a potential difference between the circuit supply node and the second control node is greater than a potential difference between the circuit supply node and the first control node; and a driver coupled to the first control node and the second control node, wherein the driver comprises an amplifier comprising a first amplifier output coupled to the first control node and a second amplifier output coupled to the second control node, a third follower transistor comprising a third control node coupled to the first amplifier output, a third follower node coupled to a first input of the amplifier, and a third supply node, and a fourth follower transistor comprising a fourth control node coupled to the second amplifier output, a fourth follower node coupled to a second input of the amplifier, and a fourth supply node.

2. The circuit of claim 1, further comprising a second voltage drop circuit coupled between a reference node and the fourth supply node.

3. The circuit of claim 2, wherein the reference node comprises the circuit supply node.

4. The circuit of claim 1, wherein the first, second, third and fourth follower transistors comprise MOS transistors, the first, second, third and fourth control nodes comprise gates, the first, second, third and fourth follower nodes comprise sources and the first, second, third and fourth supply nodes comprise drains.

5. The circuit of claim 1, wherein the first voltage drop circuit comprises a cascode transistor.

6. The circuit of claim 1, wherein the first and second follower transistors are operated in an open-loop configuration.

7. The circuit of claim 1, wherein the first control node and the second control node are biased by a replica bias circuit.

8. The circuit of claim 1, wherein the first voltage drop circuit is biased such that a potential difference between the first supply node and the first follower nodes is substantially the same as a potential difference between the second supply node and the second follower node.

9. The circuit of claim 1, wherein the first voltage drop circuit is biased to substantially minimize signal transfer from circuit supply to the voltage reference.

10. A system for generating a reference voltage, the system comprising:

an amplifier comprising a first forward path output, a second forward path output, a first feedback path input, and a second feedback path input;

a first follower transistor comprising a control node coupled to the first forward path output, and a follower output node coupled to the first feedback path input;

a second follower transistor comprising a control node coupled to the second forward path output, and a follower output node coupled to the second feedback path input;

a third follower transistor comprising a control node coupled to the first forward path output, and a follower output node coupled to a first system output;

a fourth follower transistor comprising a control node coupled to the second forward path output, and a follower output node coupled to a second system output; and an offset circuit configured to provide a voltage offset between a supply node of the first follower transistor and a supply node of the second follower transistor, and provide a corresponding voltage offset between a supply node of the third follower transistor and a supply node of the fourth follower transistor.

11. The system of claim 10, wherein the offset circuit comprises:

a first cascode transistor coupled to the supply node of the first follower transistor;

a second cascode transistor coupled to the supply node of the second follower transistor;

a third cascode transistor coupled to the supply node of the third follower transistor; and a fourth cascode transistor coupled to the supply node of the fourth follower transistor.

12. The system of claim 11, wherein the offset circuit further comprises:

a first resistor coupled to the supply node of the first cascode transistor;

a second resistor coupled to the supply node of the third cascode transistor;

a first RC low-pass filter, and current source coupled to the control node of the first cascode transistor;

a second RC low-pass filter coupled to the control node of the second cascode transistor;

a third RC low-pass filter, and current source coupled to the control node of the third cascode transistor; and a fourth RC low-pass filter coupled to the control node of the fourth cascode transistor.

13. The system of claim 11, wherein the amplifier further comprises:

a differential operational transconductance amplifier (OTA) coupled to the first and second forward path outputs; and a resistive feedback network coupled to the first and second feedback path inputs.

14. The system of claim 11, wherein:

the first, second, third and fourth follower transistors comprise MOS transistors;

the first, second, third and fourth cascode transistors comprise MOS transistors;

the control nodes of the first, second, third and fourth transistor comprise gates;

the follower output nodes of the first, second, third and fourth transistor comprise sources; and the supply nodes of the first, second, third and fourth transistor comprise drains.

15. The system of claim 14, wherein:

the first, second, third and fourth follower transistors comprise native MOS transistors; and the first, second, third and fourth cascode transistors comprise native MOS transistors.

16. A method of generating a differential reference voltage, the method comprising:

driving the differential reference voltage from a first follower node of a first transistor and a second follower node of a second transistor, wherein a voltage difference from a reference supply to the first follower node from the first transistor is less than a voltage difference from the reference supply to the second follower node of the second transistor;

providing a voltage drop from the reference supply a to supply node of the second transistor; and adjusting the voltage drop to minimize signal transfer from the reference supply to the differential reference voltage, wherein the first and second, transistors comprise MOS transistors, the first and second follower nodes comprise sources, and the supply node of the second transistor comprises a drain.

17. A method of generating a differential reference voltage, the method comprising:

driving the differential reference voltage from a first follower node of a first transistor and a second follower node of a second transistor, wherein a voltage difference from a reference supply to the first follower node from the first transistor is less than a voltage difference from the reference supply to the second follower node of the second transistor; and providing a voltage drop from the reference supply a to supply node of the second transistor; and adjusting the voltage drop to minimize signal transfer from the reference supply to the differential reference voltage;

generating a first differential voltage between a control node of the first transistor and a control node of the second transistor, generating comprising driving a control node of a first replica transistor and a control node of a second replica transistor with the first differential voltage using an amplifier, and providing feedback from follower nodes of the first and second replica transistors to at least one input of the amplifier; and driving the first and second transistors in an open-loop configuration.

18. The method of claim 17, wherein the first and second, transistors comprise MOS transistors, the first and second follower nodes comprise sources, and the supply node of the second transistor comprises a drain.

19. A reference voltage generation circuit comprising:

an amplifier;

a first follower transistor having a control node coupled to a first output of the amplifier, a follower node coupled to a first input of the amplifier, and a supply node coupled to a reference voltage;

a second follower transistor having a control node coupled to a second output of the amplifier and a follower node coupled to a second input of the amplifier, wherein the amplifier is configured to have a first potential difference between the first and second outputs of the amplifier;

a third follower transistor having a control node coupled to the first output of the amplifier, a follower node coupled to a first output of the reference voltage generation circuit, and a supply node coupled to the reference voltage;

a fourth follower transistor having a control node coupled to the second output of the amplifier and a follower node coupled to a second output of the reference voltage generation circuit;

a first voltage drop circuit coupled between a supply node of the second follower transistor and the reference voltage, the first voltage drop circuit configured to form a second potential difference between the supply nodes of the first and second follower transistors; and a second voltage drop circuit coupled between a supply node of the fourth follower transistor and the reference voltage, the second voltage drop circuit configured to form a third potential difference between the supply nodes of the third and fourth follower transistors.

20. The reference voltage generation circuit of claim 19, wherein the amplifier comprises a differential amplifier.

21. The reference voltage generation circuit of claim 19, wherein the first, second, third and fourth follower transistors comprise MOS transistors;

the control nodes of the first, second, third and fourth transistors comprise gates;

the follower nodes of the first, second, third and fourth transistors comprise sources; and the supply nodes of the first, second, third and fourth transistors comprise drains.

22. The reference voltage generation circuit of claim 19, wherein the second potential difference and the third potential difference are substantially the same.

23. The reference voltage generation circuit of claim 19, wherein the first, second and third potential difference are substantially the same.

24. The reference voltage generation circuit of claim 19, wherein the first and second voltage drop circuits each comprise a cascode transistor in series with a resistor.

25. The reference voltage generation circuit of claim 19, further comprising:

a first cascode transistor coupled between the reference voltage and the supply node of the first follower transistor;

a second cascode transistor coupled in series with the first voltage drop circuit;

a third cascode transistor coupled between the reference voltage and the supply node of the third follower transistor; and a fourth cascode transistor coupled in series with the second voltage drop circuit.

26. The reference voltage generation circuit of claim 25, wherein the first and second voltage drop circuits each comprise a resistor.

* * * * *